US006325074B1

(12) United States Patent
Strawn

(10) Patent No.: US 6,325,074 B1
(45) Date of Patent: Dec. 4, 2001

(54) HAIR CLIP HAVING JAW FOR ACCOMMODATING ORNAMENTS

(76) Inventor: Ruth Strawn, 4653 Kendrick Rd., Suitland, MD (US) 20746

( * ) Notice: Subject to any disclaimer, the term of this patent is extended or adjusted under 35 U.S.C. 154(b) by 0 days.

(21) Appl. No.: 09/694,565

(22) Filed: Oct. 24, 2000

(51) Int. Cl.[7] ..... A45D 8/20

(52) U.S. Cl. ..... 132/277; 132/275; 63/28; 63/43

(58) Field of Search ..... 132/275, 276, 132/277, 278, 279; D28/39, 40, 42, 43; 63/3, 7, 26, 28, 29.1, 43

(56) References Cited

U.S. PATENT DOCUMENTS 1,586,025 * 5/1926 Burkhart ..... 132/277
2,133,145 * 10/1938 Jones ..... 132/277
2,160,346 * 5/1939 Valentine ..... 132/277
2,200,624 * 5/1940 Jones ..... 132/277
2,594,230 * 4/1952 Solomon et al. ..... 132/279
4,912,944 * 4/1990 Crosley et al. ..... 132/275
5,857,469 * 1/1999 Sowell ..... 132/275

* cited by examiner

*Primary Examiner*—Todd E. Manahan
*Assistant Examiner*—David Comstock
(74) *Attorney, Agent, or Firm*—Smith Patent Office

(57) ABSTRACT

A hair clip with an efficient clamping jaw construction that contains an ornamental design and can accommodate a large variety of ornaments having numerous colors and shapes without increasing the problem of hair entanglement is disclosed. The hair clip comprises a top jaw having a flat center portion and two side wing portions, a bottom jaw opposing the top jaw for grasping hair in cooperation with the top jaw and a jaw opening mechanism for opening the top jaw and the bottom jaw. The side wing portions of the hair clip are disposed at an angle substantially 45 degrees with respect to the center portion. The hair clip allows the consumer to create their own style and color of ornamentation that is easily and securely accommodated to the hair clip and also a manufacturer to modify or customize the ornamentation to suit fashion trends.

4 Claims, 6 Drawing Sheets

HAIR CLIP HAVING JAW FOR ACCOMMODATING ORNAMENTS

BACKGROUND OF THE INVENTION

1. Field of the Invention

The present invention relates to a hair clip. In particular, this invention is directed to a hair clip having a structure such that a variety of decorative ornamentations can be accommodated easily and securely to the hair clip.

2. Discussion of the Related Art

Hair clips have been used for a long time to keep hair up in a particular style or to keep hair away from the face and eyes. In addition to its functionality, hair clips also provide the user with an opportunity to add an ornamental flair to their hair.

U.S. Pat. No. Des. 348,121 to Park discloses a hair clip. This hair clip has a prominent curve on the upper bill and a straight lower bill. Park does not suggest that ornamentation can be affixed to the upper bill, and the side wings of the upper bill of Park are too upright to allow ornaments such as beads or jewels to be sufficiently visible.

U.S. Pat. No. Des. 117,861 to Woodford discloses a hair curler having parallel clamping jaws wherein the top jaw has a groove. However, this device is a hair curler and there is no suggestion that the groove can be used for ornamentation. Indeed, there would be no point to the curling device having ornamentation and the design of the groove has upright wings that would conceal any ornamentation affixed within it.

A problem frequently arises that the hair pin can become tangled in the hair making it difficult for the user to clip or unclip the hair. This problem is exacerbated when an ornament or the like is present on the hair clip. The presence of an ornament greatly increases the chance of entangling the hair in the clip. For example, U.S. Pat. No. 3,106,215 to Grandis et al discloses an improvement to a hair clip in which the upper jaw serves as a clamp and as an ornament. This clip, however, can suffer from the problem that hair can be easily tangled in the ornamentation. Further, the ornament is limited in design to a floral shape and there is no ability of the Grandis et al hair clip to change the design easily.

Another problem with conventional hair clips is that the user may want the hair clip to hold the hair effectively but not want the non-ornamental parts of the clip to be visible. For example U.S. Pat. No. Des. 177,617 to Ecker et al discloses an essentially flat, metal clip with ornamentation disposes on the handle portion. The Ecker et al clip suffers from the problem that the hair can easily become tangled in the clip. Further, the functional part of the clip, i.e. the clamping portion contains no ornamentation. Thus, the clamping portion is visible. Moreover, the design cannot accommodate the user's own ornaments and the design itself is limited to a bow.

A still further problem with hair clips is that they contain very little or no ornamentation at all. For example, U.S. Pat. Des. Nos. 415,312 and 403,111 show a duckbill type hair clip that contains no ornamentation. Moreover, they have no ability to accommodate easily and securely ornamentation selected by a user or designer.

Thus, conventional hair clips have limited types of designs or no ornamentation at all. No clips allow the consumer to add their own ornaments such as beads or jewels to the hair clip. A manufacturer is generally limited by existing molds and cannot continually modify their designs to suit market trends. In addition, the colors of the ornaments may also be limited, and the manufacturer may lack flexibility in changing colors.

Other problems arise because the ornament is not securely fastened to the clip. This can cause the ornament to fall off during use sometimes soon after the consumer purchases it.

SUMMARY OF THE INVENTION

In view of the foregoing, it is an object of the invention to provide a hair clip with an efficient clamping jaw construction that contains an ornamental design.

A further object of the invention is to provide a hair clip with an elegant and decorative appearance without increasing the problem of hair entanglement.

A still further object of the invention is to provide a hair clip that is safe to use and inexpensive to manufacture.

In addition, an object of the invention is to provide a hair clip capable of accommodating a large variety of ornaments having numerous colors and shapes.

Another object of the invention is to provide a hair clip that allows the consumer to create their own style and color of ornamentation that is easily and securely accommodated to the hair clip.

Yet another object of the invention is to provide a hair clip that allows a manufacturer to modify or customize the ornamentation to suit fashion trends.

A further object of the invention is to provide a hair clip whose ornamentation is clearly visible above the hair, but whose functional components are concealed.

These and other objects and advantages are accomplished by a hair clip, comprising a top jaw having a center portion and two side wing portions, said side wing portions being disposed at an angle substantially 45 degrees with respect to said center portion, a bottom jaw opposing said top jaw for grasping hair in cooperation with said top jaw, and a jaw opening mechanism for opening said top jaw and said bottom jaw.

In a further embodiment, the opening mechanism comprises a top clamping member attached at one end of said top jaw at an angle with respect to said top jaw, a bottom clamping member attached to said bottom jaw and opposing, said top clamping member, a bolt which interlocks said top clamping member and said bottom clamping member; and a tension spring disposed around the bolt to bias said top jaw and said bottom jaw in a closed position.

In a still further embodiment, the hair clip further comprises one or more ornamentations accommodated to the center portion of said top jaw between said two side wings.

DETAILED DESCRIPTION OF THE PREFERRED EMBODIMENTS

Figure 1:
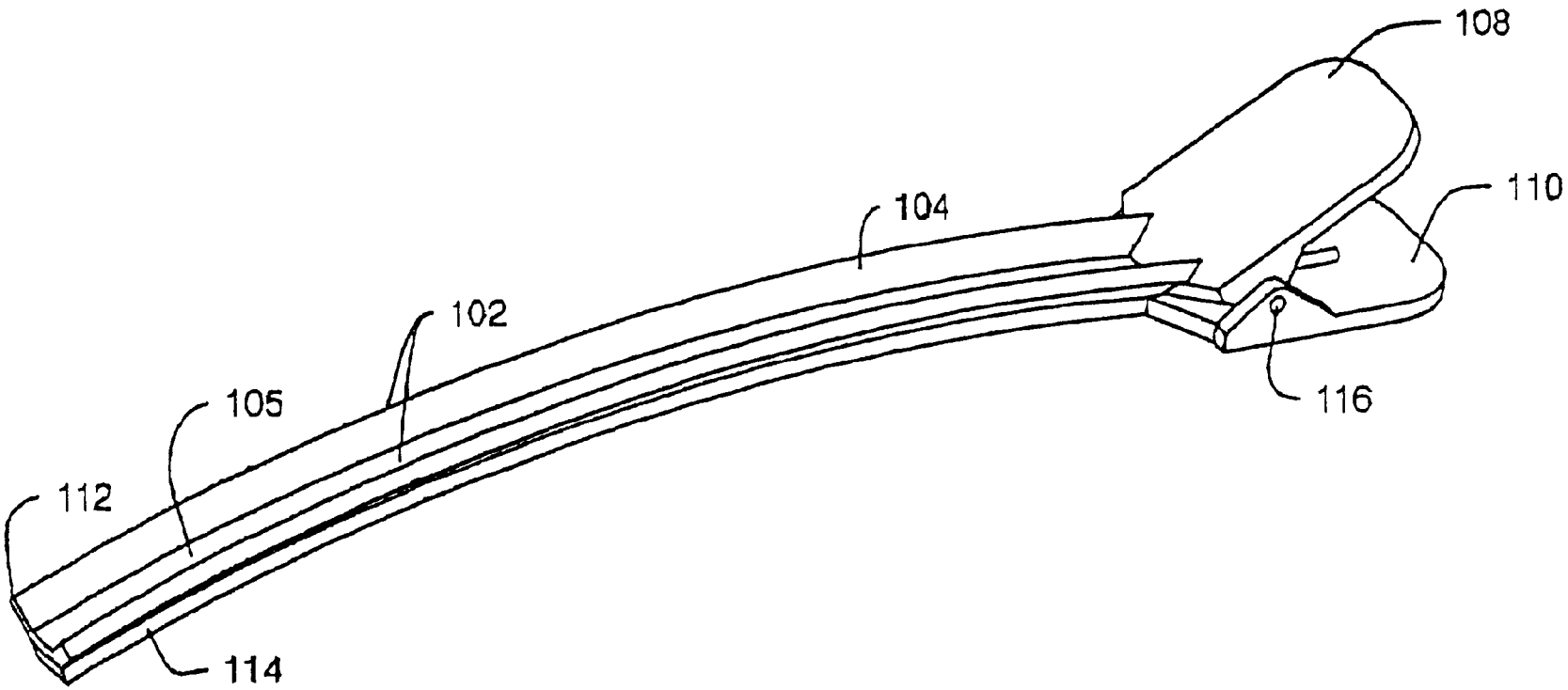
FIG. 1 is a perspective view of the hair clip.
Figure 2:
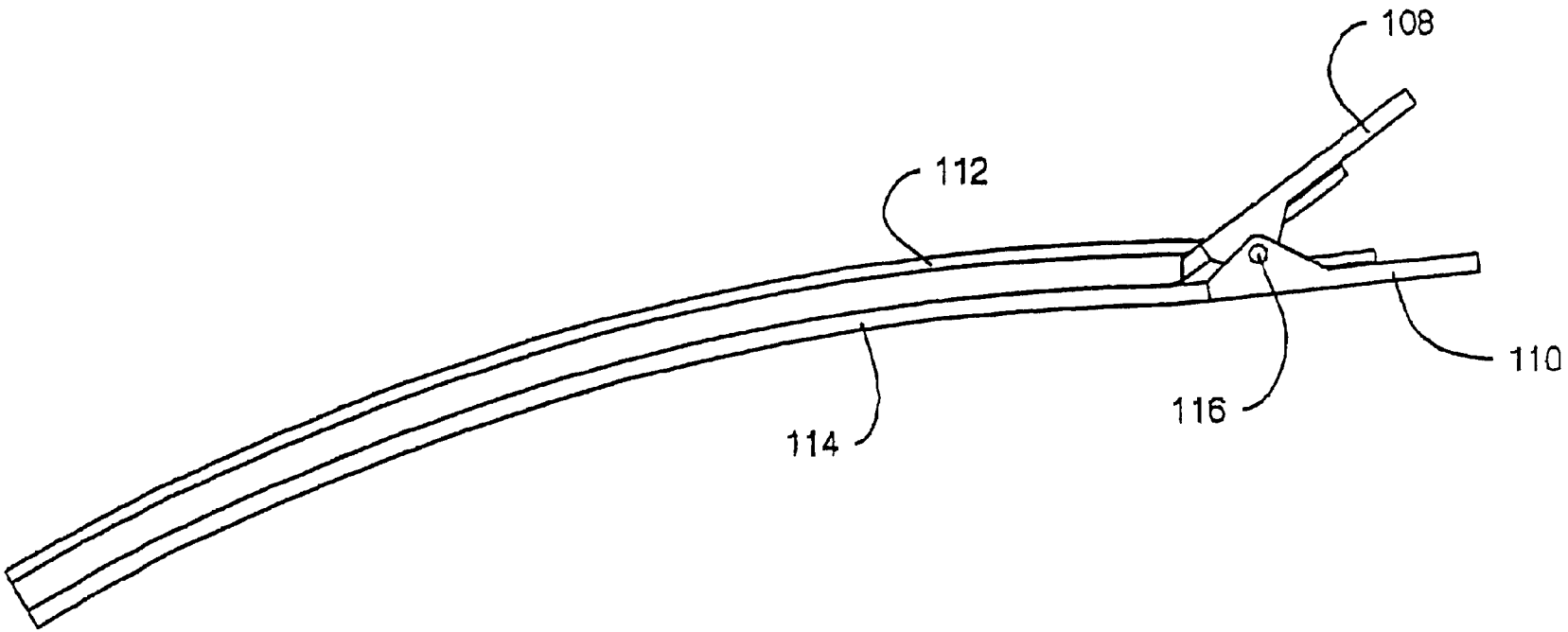
FIG. 2 is a side view of the hair clip.
Figure 3:
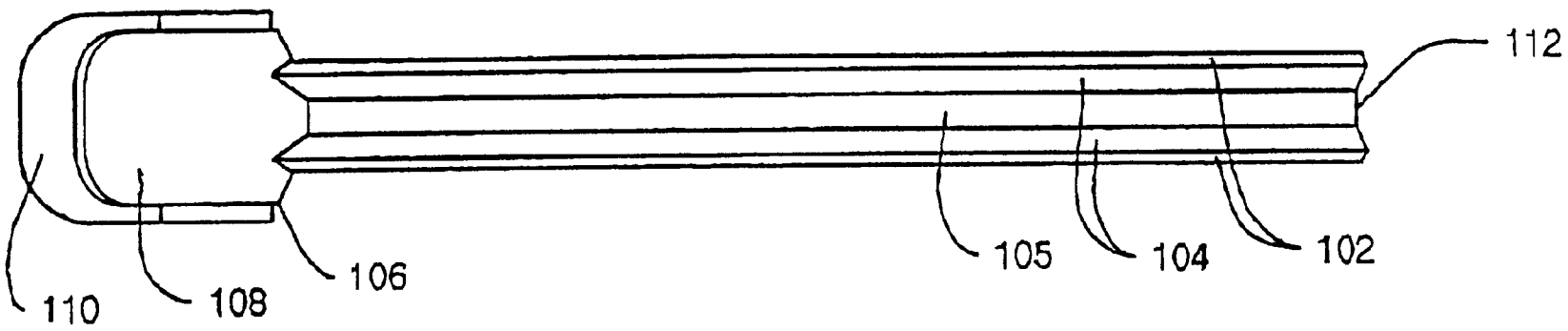
FIG. 3 is a top exploded view of the hair clip.
Figure 4:
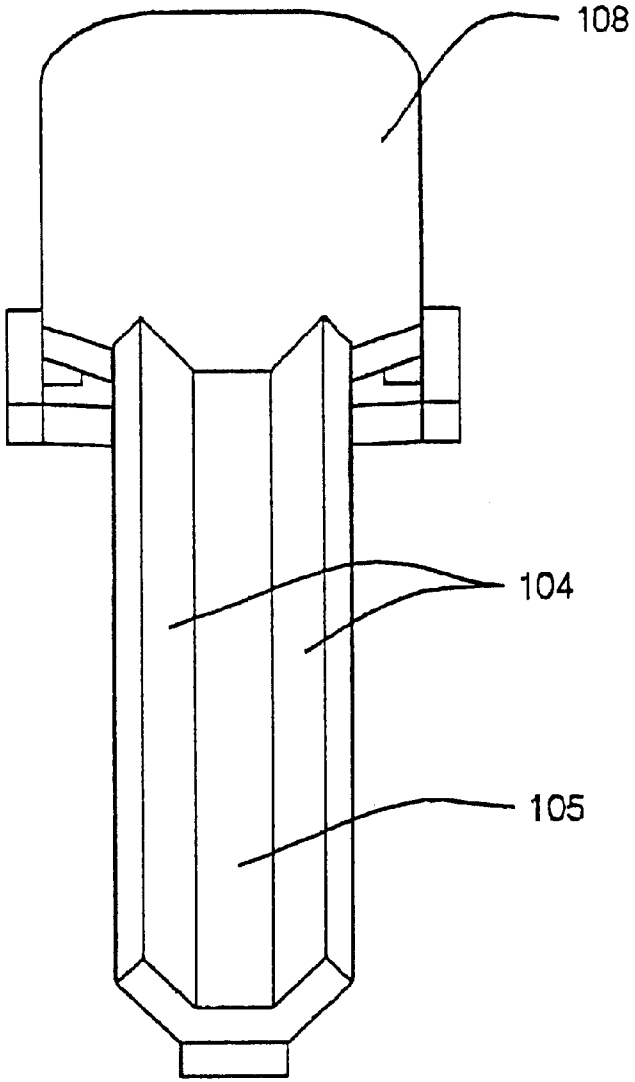
FIG. 4 is a front view of the hair clip.

As shown in FIGS. 1 to 3, the hair clip 100 has a top jaw 112 that has a center portion 105 and two side wing portions 102,102. The side wing portions 102,102 are disposed at an angle substantially 45 degrees with respect to the center portion 105. The angle between the center portion and the side wings is for the purpose of accommodating one or more ornaments (not shown) that can be positioned, for example, in a row along the center portion 105. The ornaments can be accommodated to the inner surfaces 104,104 of the side wings 102,102 and the center portion 105. The ornaments can be securely accommodated, for example, using an adhesive. Any suitable method can be used to affix the ornaments to the top jaw 112.

A bottom jaw 114 opposes the top jaw 112 and is generally parallel to it. The hair is grasped between the bottom jaw and the top jaw that are biased in the closed position. The top jaw and bottom jaw can be generally straight or they can be arcuate as shown in the figures. It is generally desirable that the top jaw and bottom jaw possess only a slight curve since the curves on the head are generally gradual.

The top jaw can be any desired length, but a length of between four and six inches is generally preferred based on the average head size. A length of 5.5 inches is particularly preferred.

As shown in FIG. 3, the top jaw is wide enough to accommodate ornaments. Based on particularly desirable ornaments, a width of between ¼ inch and ½ inch is preferred, and a width of 5/16 inch is particularly preferred. In this case, the width of the side wings varies from about 1/16 inch to 3/16 inches. A width of ⅛ inch is particularly preferred. Further, the center portion has a width of about 1/16 inch to 4/16 inches.

Based on this design, one or more ornaments can be accommodated to the top jaw 112, preferably in a row, in the center portion 105 between the side wings 102,102. The angle of the side wings 102,102 with respect to the center portion 105 is particularly important. If the side wings were upright, that is at an angle of 90 degrees with respect to the center portion, the ornaments would not be sufficiently visible above the side wings.

It is preferred that the top and bottom jaws have a smooth finish to prevent damage to the hair during use. Therefore, it is desirable that the bottom jaw be made of plastic or have a plastic coating or other smooth finish. Even more preferred, the top jaw is also made of a plastic material or has at least the bottom portion thereof coated with plastic or other smooth finishing material.

The top jaw and the bottom jaw are pivotally connected to one another by means of an opening mechanism located at one end of the jaws. The opening mechanism is preferably a top clamping member 108 and a bottom clamping member 110. The clamping members can be separate components that are rigidly connected to the top and bottom jaws. Alternatively, the top clamping member and top jaw can be integrated as a single piece, and the bottom clamping member and bottom jaw can be integrated as a single piece. The top clamping member 108 is preferable angled upward with respect to the top jaw.

Figure 5:
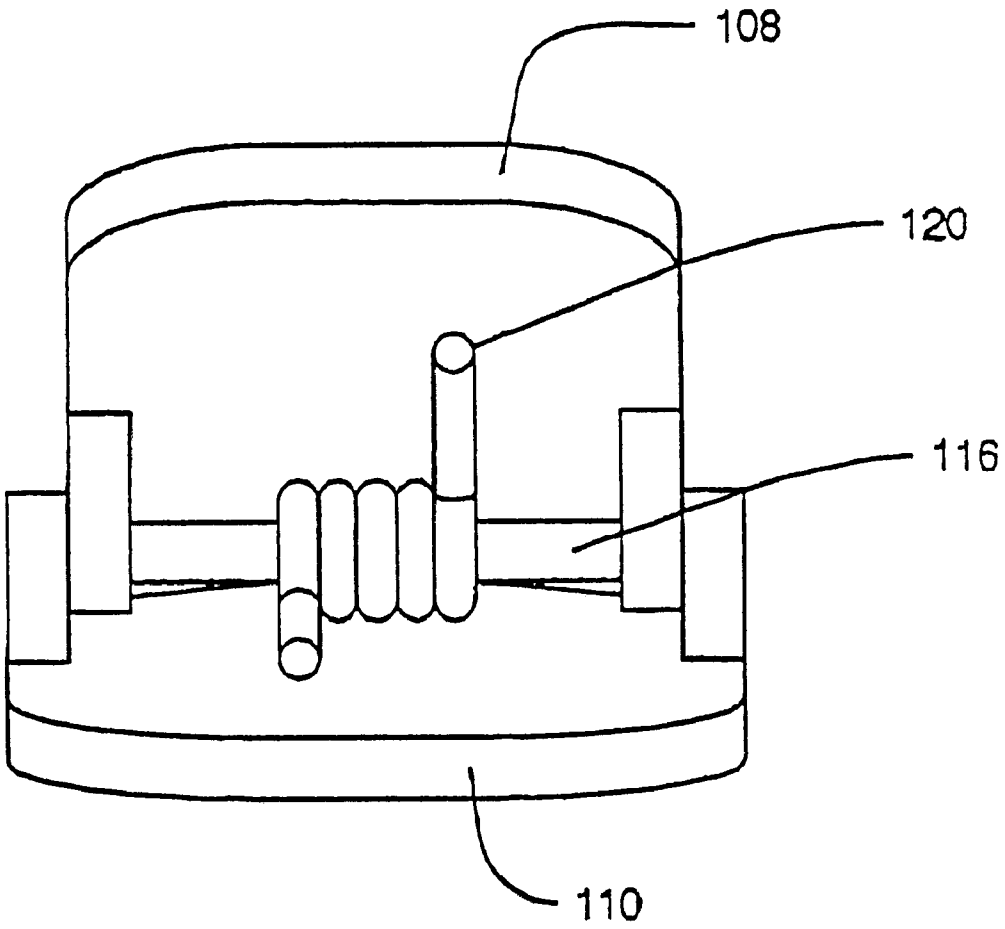
FIG. 5 is a rear exploded view of the hair clip.

The top and the bottom clamping member are pivotably connected to each other by means of a bolt 116. As the clamping members are urged toward each other, the jaws open. As shown in FIG. 5, a tension spring is disposed around the bolt 116. The tension spring keeps the top clamping member and bottom clamping member biased apart from each other. This in turn biases the top jaw and the bottom jaw in the closed position. Thus, in order to position the hair clip in the hair, the user squeezes the clamping members together, inserts the bottom jaw under the hair to be held and releases the clamping members.

The angle of the side wings 102,102 with respect to the center portion 105 is particularly important. If the side wings were upright, that is at an angle of 90 degrees with respect to the center portion, the ornaments would not be sufficiently visible above the side wings.

Figure 6:
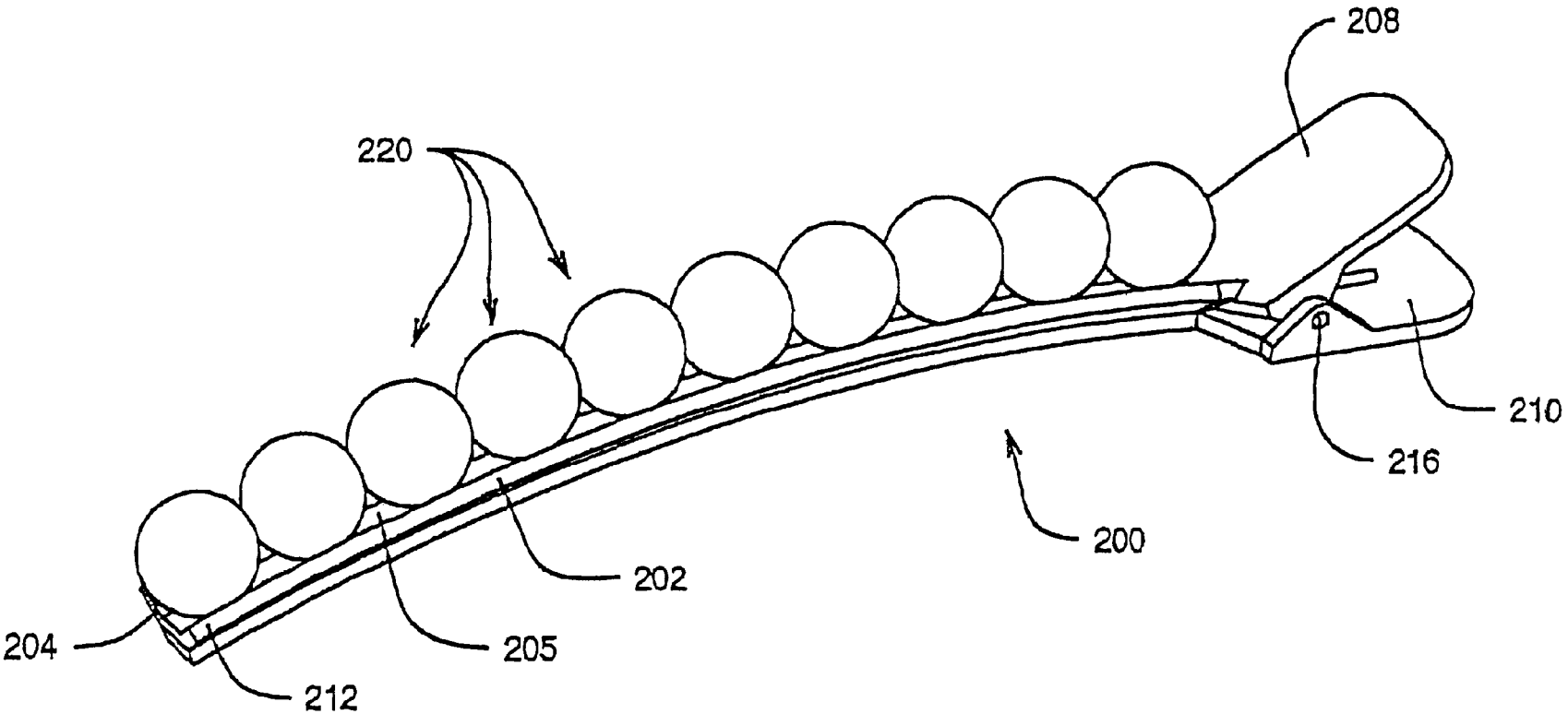
FIG. 6 is a perspective view of the hair clip, showing the hair clip with ornamentations on the top jaw.

As shown in FIG. 6, a hair clip 200 has a top jaw 212 that has a center portion 205 and two side wing portions 202. The side wing portions 202 are disposed at an angle substantially 45 degrees with respect to the center portion 205. The angle between the center portion 205 and the side wing portions 202 is for the purpose of accommodating one or more ornaments 220 that can be positioned, for example, in a row along the center portion 205. The ornaments 220 can be accommodated or attached to the top jaw 212 of hair clip 200, preferably in a row, in the center portion 205 between the side wings 202. The ornaments 220 can be accommodated or attached to the inner surfaces 204 of the side wings 202. Further, the ornaments can be securely accommodated, for example, using an adhesive for fixing devices such as screws. Any suitable method can be used to securely accommodate the ornaments to the top jaw 212. The angle of the side wings 202 with respect to the center portion 205 is particularly important. If the side wings were upright, that is at an angle of 90 degrees with respect to the center portion, the ornaments would not be sufficiently visible above the side wings and they would not necessarily hide the hair clip below. If the side wings are too horizontal, then it is difficult to insert the hair clip and there is no balancing support for the ornaments.

The type, color and quantity of suitable ornaments are limited only by the size of the groove created in the top jaw between the side wings. Examples of ornaments that could be used in the hair clip include jewels such as precious stones, semiprecious stones or costume jewels, and beads made of plastic or metal.

The hair clip is particularly useful for holding a French roll with the effect that the ornaments in the hair clip accent the roll. The hair clip can also be used in any traditional way such as an upsweep in which the hair is combed or brushed upward near the crown of the head or the side-sweep to hold hair away from the face.

The manufacturer of the hair clip may affix the ornaments to the hair clip during manufacturing. However, the hair clip can be packaged in such a way as to allow the user to place their own ornaments in the top jaw. This can be done by supplying the user with beads or other ornaments and the user can create their own designs and affix the ornaments to the top jaw. Alternatively, the user can purchase their own ornaments and affix them to the top jaw.

What is claimed is:

1. A hair clip, comprising:

a top jaw having a flat center portion and two side wing portions, each of said side wing portions being disposed at an angle substantially 45 degrees with respect to said flat center portion;

a bottom jaw opposing said top jaw for grasping hair in cooperation with said top jaw;

a jaw opening mechanism for opening said top jaw and said bottom jaw; and at least one ornament disposed in said flat center portion of said top jaw between said two side wing portions.

2. A hair clip according to claim 1, wherein said opening mechanism comprises:

a top gripping member attached at one end of said top jaw at an angle with respect to said top jaw;

a bottom griping member attached to said bottom jaw and opposing said top gripping member;

a bolt which pivotably connects said top gripping member and said bottom gripping member; and a tension spring disposed around the bolt to bias said top jaw and said bottom jaw in a closed position.

3. A hair clip according to claim 1, wherein said ornament is removable from said flat center portion of said top jaw between said two side wing portions so as to be arranged or changed with another ornament as desired.

4. A hair clip, comprising:

a top jaw having a flat center portion and two side wing portions, each of said side wing portions being disposed at an angle with respect to said flat center portion;

a bottom jaw opposing said top jaw for grasping hair in cooperation with said top jaw;

a jaw opening mechanism for opening said top jaw and said bottom jaw; and at least one ornament disposed on said flat center portion of said top jaw between said two side wing portions.

* * * * *